US011311770B2

(12) United States Patent
Coulter et al.

(10) Patent No.: US 11,311,770 B2
(45) Date of Patent: Apr. 26, 2022

(54) ADJUSTABLE FITNESS BENCH

(71) Applicant: Dick's Sporting Goods, Inc., Coraopolis, PA (US)

(72) Inventors: Derek Coulter, Coraopolis, PA (US); Lucas Ferrari, Clinton, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 218 days.

(21) Appl. No.: 16/720,530

(22) Filed: Dec. 19, 2019

(65) Prior Publication Data

US 2021/0187342 A1 Jun. 24, 2021

(51) Int. Cl.
*A63B 21/00* (2006.01)
*A63B 21/078* (2006.01)

(52) U.S. Cl.
CPC ..... *A63B 21/4029* (2015.10); *A63B 21/4047* (2015.10); *A63B 21/0783* (2015.10); *A63B 2208/0228* (2013.01); *A63B 2225/09* (2013.01)

(58) Field of Classification Search
CPC ..... A63B 21/4029; A63B 21/4047; A63B 21/0783; A63B 2208/0228; A63B 2225/09; A63B 2208/0242; A63B 21/078
See application file for complete search history.

(56) References Cited

U.S. PATENT DOCUMENTS 4,397,462 A * 8/1983 Wilmarth ..... A63B 21/0087 482/137
4,635,930 A * 1/1987 Cormier ..... A63B 21/078 482/104
4,635,934 A * 1/1987 Roethke ..... A63B 23/00 482/104
4,765,616 A 8/1988 Wolff
4,830,363 A * 5/1989 Kennedy ..... A63B 21/4033 434/254
4,848,739 A * 7/1989 Schaub ..... A63B 21/00072 482/113
4,861,025 A * 8/1989 Rockwell ..... A63B 21/06 482/142
4,936,572 A * 6/1990 Desiderio ..... A63B 21/078 482/142
5,042,799 A * 8/1991 Stanley ..... A63B 21/4005 482/114
5,106,081 A * 4/1992 Webb ..... A63B 23/0405 482/137
5,125,881 A * 6/1992 Jones ..... A63B 23/1245 482/93

(Continued)

OTHER PUBLICATIONS

Bodycraft F320 Flat/Incline/Decline System Bench : <https://www.bodycraft.com/f320-f-i-d-bench.html>.

(Continued)

*Primary Examiner* — Garrett K Atkinson
(74) *Attorney, Agent, or Firm* — Fox Rothschild LLP

(57) ABSTRACT

An adjustable fitness bench includes a base frame, a shuttle slidable along at least a portion of the base frame, a support bar pivotally connected to the base frame, a seat back pivotally connected to the shuttle and the support bar, a seat bottom pivotally connected to the shuttle, and a link. The link includes a first end connected to the seat back, and a second end configured to rest against an undersurface of the seat bottom when the adjustable fitness bench is in a horizontal position.

21 Claims, 15 Drawing Sheets

(56) References Cited

U.S. PATENT DOCUMENTS 5,141,480 A * 8/1992 Lennox ..... A63B 21/4029 482/142
5,190,510 A * 3/1993 Goodger ..... A63B 21/4029 482/104
5,324,247 A * 6/1994 Lepley ..... A63B 21/4033 482/136
5,350,346 A 9/1994 Martinez
5,385,322 A * 1/1995 Kim ..... A47B 21/0371 5/652
5,437,236 A * 8/1995 Zeiner ..... A47B 9/10 312/231
5,447,480 A * 9/1995 Fulks ..... A63B 23/03566 482/99
5,601,519 A * 2/1997 Comereski ..... A63B 21/169 601/24
5,727,764 A 3/1998 Angeles
5,743,832 A * 4/1998 Sands ..... A63B 21/4031 482/52
5,795,271 A * 8/1998 Pearson ..... A63B 23/03525 482/142
5,840,001 A * 11/1998 Schedel ..... A61H 1/0218 606/244
6,264,586 B1 * 7/2001 Webber ..... A63B 23/00 482/142
6,371,896 B1 4/2002 Kettler
6,475,127 B1 * 11/2002 Koenig ..... A63B 21/078 482/142
6,605,023 B1 * 8/2003 Mobley ..... A63B 21/4029 482/142
6,645,130 B2 11/2003 Webber
6,659,923 B2 * 12/2003 Teuscher ..... A63B 21/4029 482/148
6,685,601 B1 2/2004 Knapp
6,689,027 B1 * 2/2004 Gardikis, Jr. ..... A63B 21/078 482/142
6,805,409 B2 10/2004 Parker
6,966,872 B2 11/2005 Eschenbach
7,291,102 B2 11/2007 Mackert et al.
7,331,912 B2 * 2/2008 Keiser ..... A63B 21/4029 482/142
7,384,383 B2 * 6/2008 Forcillo ..... A63B 21/4031 482/142
7,429,236 B2 9/2008 Dalebout et al.
7,465,260 B2 12/2008 Hockemeyer
7,591,764 B2 * 9/2009 Zuckerman ..... A63B 21/4029 482/130
7,591,770 B2 9/2009 Stewart et al.
7,604,583 B2 * 10/2009 Denisco ..... A63B 26/00 482/145
7,674,215 B1 * 3/2010 Swanson ..... A63B 23/00 482/142
7,779,494 B2 * 8/2010 Poulos ..... A61G 7/16 5/618
7,922,630 B1 * 4/2011 Batea ..... A63B 23/12 482/142
7,944,208 B2 * 5/2011 Dutto ..... A61B 5/055 324/309
8,012,072 B2 * 9/2011 Forcillo ..... A63B 21/4029 482/145
8,021,285 B2 * 9/2011 Kushnir ..... A63B 21/008 482/37
8,069,514 B2 * 12/2011 Poulos ..... A61G 7/002 5/613
8,151,812 B2 * 4/2012 Razon ..... A61H 3/04 297/195.1
8,336,140 B2 * 12/2012 Parson ..... A61G 5/1059 5/619
8,701,229 B2 * 4/2014 Lemire ..... A61G 7/052 5/510
8,801,638 B2 * 8/2014 Gierse ..... A61G 7/1096 601/24
8,864,233 B2 * 10/2014 Wei ..... A47C 1/022 297/195.11
8,899,680 B2 * 12/2014 Meier ..... A47C 1/03266 297/303.4
8,926,480 B2 1/2015 Lyszczarz
9,004,508 B2 4/2015 Tsukada et al.
9,248,329 B2 2/2016 Heideman
9,248,337 B1 * 2/2016 Humphrey ..... A63B 21/00181
9,433,818 B2 * 9/2016 Kalleen ..... A63B 71/0054
9,474,923 B2 10/2016 Davenport
9,555,274 B1 1/2017 Cassidy et al.
9,770,618 B2 9/2017 Wall
10,010,740 B2 7/2018 Hockridge et al.
10,016,646 B2 7/2018 Butler
10,265,599 B2 4/2019 Heideman
10,589,144 B2 * 3/2020 Specht ..... A63B 21/4029
2001/0018387 A1 * 8/2001 Webber ..... A63B 21/078 482/145
2003/0199370 A1 * 10/2003 Bucay-Bissu ..... A63B 21/4031 482/142
2005/0032614 A1 * 2/2005 Keiser ..... A63B 21/4029 482/142
2005/0181917 A1 * 8/2005 Dayal ..... A61H 1/0222 482/142
2006/0035769 A1 * 2/2006 Phillips ..... A61H 1/003 482/142
2006/0073944 A1 * 4/2006 Zuckerman ..... A63B 21/4029 482/56
2006/0217240 A1 * 9/2006 White ..... A63B 21/068 482/95
2007/0099777 A1 * 5/2007 Forcillo ..... A63B 21/4047 482/142
2009/0137370 A1 * 5/2009 Kushnir ..... A63B 21/151 482/120
2009/0203505 A1 * 8/2009 Kroll ..... A63B 21/078 482/104
2009/0289633 A1 * 11/2009 Dutto ..... G01R 33/307 324/318
2010/0249495 A1 * 9/2010 Siradag ..... A47C 15/008 600/38
2011/0263389 A1 * 10/2011 Burgassi ..... A63B 21/4047 482/79
2013/0203569 A1 * 8/2013 Athis ..... A63B 21/0552 482/142
2014/0137328 A1 5/2014 Ohta et al.
2014/0296042 A1 * 10/2014 Snyder ..... A63B 21/00072 482/137
2015/0224359 A1 * 8/2015 Kalleen ..... A63B 71/0054 482/104
2018/0099176 A1 * 4/2018 Specht ..... A63B 21/4029
2019/0118028 A1 4/2019 Mancias
2019/0151699 A1 5/2019 Isom
2021/0228940 A1 * 7/2021 Mc Dougle ..... A63B 21/4047

OTHER PUBLICATIONS

Body Solid GF-121 2x3 Bench: <https://www.bodysolid.com/home/gfi21/body-solid_heavy_duty_flat_incline_bench>.
Life Fitness Signature Series Multi-Adjustable Bench: <https://lifefitness.com/facility/products/signature-series/multi-adjustable-bench>.
Life Fitness Adjustable Bench: <https://www sears.com/life-fitness-multi-position-bench/p-00615231000P?sid=IDx20070921x00003c>.
Hoist Fitness Systems HF-5170 7-Position F.I.D. Olympic Bench: <https://www.hoistfitness.com/products/hf-5170-7-position-f-i-d-olympic-bench>.
Hoist Fitness Systems HF-4167 Fold-up Flat to Incline Bench: <https://www.treadmilloutlet.com/hoist-fitness-hf-4167-fold-up-flat-to-incline-bench.html>.

* cited by examiner

ADJUSTABLE FITNESS BENCH

BACKGROUND

Adjustable benches, such as, for example, fitness benches, may have various designs including without limitation, fixed horizontal, fixed inclined, fixed decline, or with one or more adjustable portions. A common problem with fitness benches having adjustable portions is a noticeable gap between a movable seat back and a seat bottom when the seat back is in the inclined position. This gap can cause discomfort to a user while weight training or otherwise using the bench.

In addition, adjustable benches that are used with a weight rack often position a user away from the weight rack when the bench is adjusted. This can create a safety issue for the user.

SUMMARY

In an embodiment, an adjustable fitness bench includes a base frame, a shuttle slidable along at least a portion of the base frame, a support bar pivotally connected to the base frame, a seat back pivotally connected to the shuttle and the support bar, a seat bottom pivotally connected to the shuttle, and a link. The link includes a first end connected to the seat back, and a second end configured to rest against an undersurface of the seat bottom when the adjustable fitness bench is in a horizontal position.

A portion of the link may be configured to slide along at least a portion of the undersurface. The link may include a plurality of link hook portions that each extend away from a first end of the link and upward toward a second end of the link. The link may include a link end located at the second end of the link, where the link end may be configured to attach to a portion of each of the link hook portions, and slide along at least a portion of the undersurface. The link may include a link plate positioned such that it covers at least a portion of each of the link hook portions, where the link plate is configured to attach to the seat back.

Optionally, the shuttle may include a first extension having a first pivot connection, and a second extension having a second pivot connection. The seat back may be pivotally connected to the first extension, and the seat bottom may be pivotally connected to the second extension.

One or more of the seat back or the seat bottom may be configured to transition between the horizontal position and at least one incline position when the shuttle is moved along the base frame. The shuttle may include a bumper along an upper surface, and the seat bottom may be configured to rest against at least a portion of the bumper in the at least one incline position. The seat bottom may include a bumper on the undersurface, where the bumper may be configured to contact the shuttle in the at least one incline position. The shuttle may include a connector that is configured to restrict movement of the shuttle along the base frame when in an engaged position. The connector may include one or more of the following: a spring pin, a push clip, a bolt, a sliding pin, or a threaded pin. The shuttle may include a securing member configured to secure the shuttle to the base frame.

Optionally, the base frame may include a post, and the seat back may be configured to rest against a top surface of the post in the flat position. The post may include a bumper along the top surface upon which the seat back is configured to rest.

In an embodiment, an adjustable fitness bench may include a base frame, a shuttle slidable along at least a portion of the base frame, a support bar pivotally connected to the base frame, a seat back pivotally connected to the shuttle and the support bar, a seat bottom pivotally connected to the shuttle, and a link. The link includes a first end connected to the seat back, and a second end configured to not contact the seat bottom when the adjustable fitness bench is in a vertical position.

The link may include a plurality of link hook portions that each extend away from a first end of the link and upward toward a second end of the link, where at least a portion of the second end of the link is configured to slide along at least a portion of an undersurface of the seat bottom when the bench is transitioned between the vertical position and a horizontal position.

The link may include a plurality of link hook portions that each extend away from a first end of the link and upward toward a second end of the link, where the second end of the link comprises a link end that is configured to slide along at least a portion of an undersurface of the seat bottom when the bench is transitioned between the vertical position and a horizontal position.

The link further may include a link plate that is configured to attach to the seat back. The link may include a plurality of link hook portions that each extend away from a first end of the link and upward toward a second end of the link, where a surface of each of the link hook portions is configured to attach to the seat back.

In an embodiment, a link for an adjustable fitness bench includes a plurality of link hook portions that each extends from a first end of the link upwards toward a second end of the link, where at least a portion of the first end of the link is configured to attach to a seat back of an adjustable fitness bench, where at least a portion of the second end is configured to slide along at least a portion of an undersurface of a seat bottom of the adjustable fitness bench when a position of the seat back or seat bottom is adjusted.

DETAILED DESCRIPTION

Terminology that is relevant to this disclosure is provided at the end of this detailed description. The illustrations are not to scale.

Figure 1:
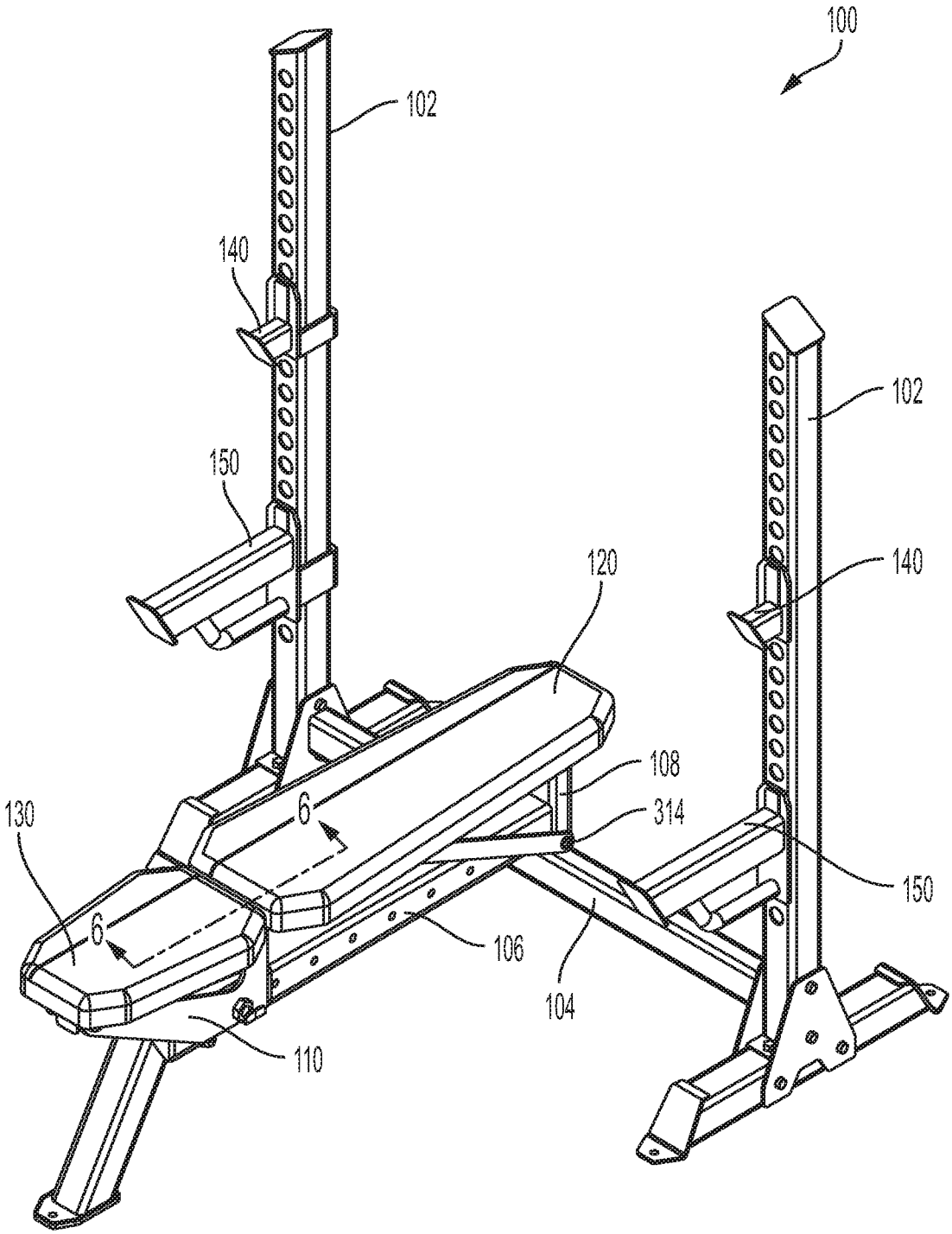
FIG. 1 illustrates an isometric view of an example adjustable fitness bench.

FIG. 1 illustrates an isometric view of an example adjustable fitness bench 100. An adjustable fitness bench 100 may be used to assist with one or more exercises or fitness activities, such as, for example, weight lifting, resistance training, or other training. As discussed in more detail below, the adjustable fitness bench 100 has one or more adjustable portions that may be used for flat, incline, and/or decline configurations or arrangements of the adjustable fitness bench 100. In a flat configuration, the seat bottom and the seat back may be in a horizontal position such that they form a substantially horizontal surface on which a user may sit, lie or otherwise utilize. In a vertical position, a seat bottom and a seat back may be substantially perpendicular to one another. For example, in a vertical position, a seat bottom may support a user's posterior, while the seat back may support the user's back.

The adjustable fitness bench 100 may include two upright posts 102 connected by a crossmember 104, a base frame 106 fixed to the crossmember 104, a shuttle 110 slidable along the base frame 106, with a seat back 120, and/or a seat bottom 130 pivotally connected to the shuttle 110. In various embodiments, the seat back 120 may support at least a portion of a user's torso while the seat bottom 130 may support at least a portion of a user's bottom (such as the buttocks). In the flat configuration, the seat back 120 and the seat bottom 130 may be substantially coplanar and level. In an incline configuration, the seat back 120 may be raised above seat bottom 130 forming a substantially chair-like configuration. Likewise, in a decline configuration, the seat back 120 may be lowered below the seat bottom 130 forming a substantially downward slanting bench. A user may select the seat back 120 and seat bottom 130 configuration depending on the desired exercise to perform.

The adjustable fitness bench 100 may include a seat back 120 and seat bottom 130 supported by a base frame 106. The base frame may include a support post 108 supporting one end of the seat back 120. A shuttle 110 may slide along the base frame 106 and may pivotally connect the seat back 120 and/or the seat bottom 130 to the base frame 106. An optional crossmember 104 may be connected to the base frame 106. Two upright posts 102 may be connected by the crossmember 104. The crossmember 104 may be connected to the upright posts 102 near a bottom end portion. One or more of the upright posts 102 may be used for racking plate weights. Optional supports 140, such as, for example, J-hooks, and spotter arms 150 may be height adjustable by the user connecting them to various openings along the upright posts 102. The height of the supports 140 and spotter arms 150 may be adjustable by the user by connecting them to various openings along the upright posts 102.

Figure 2A:
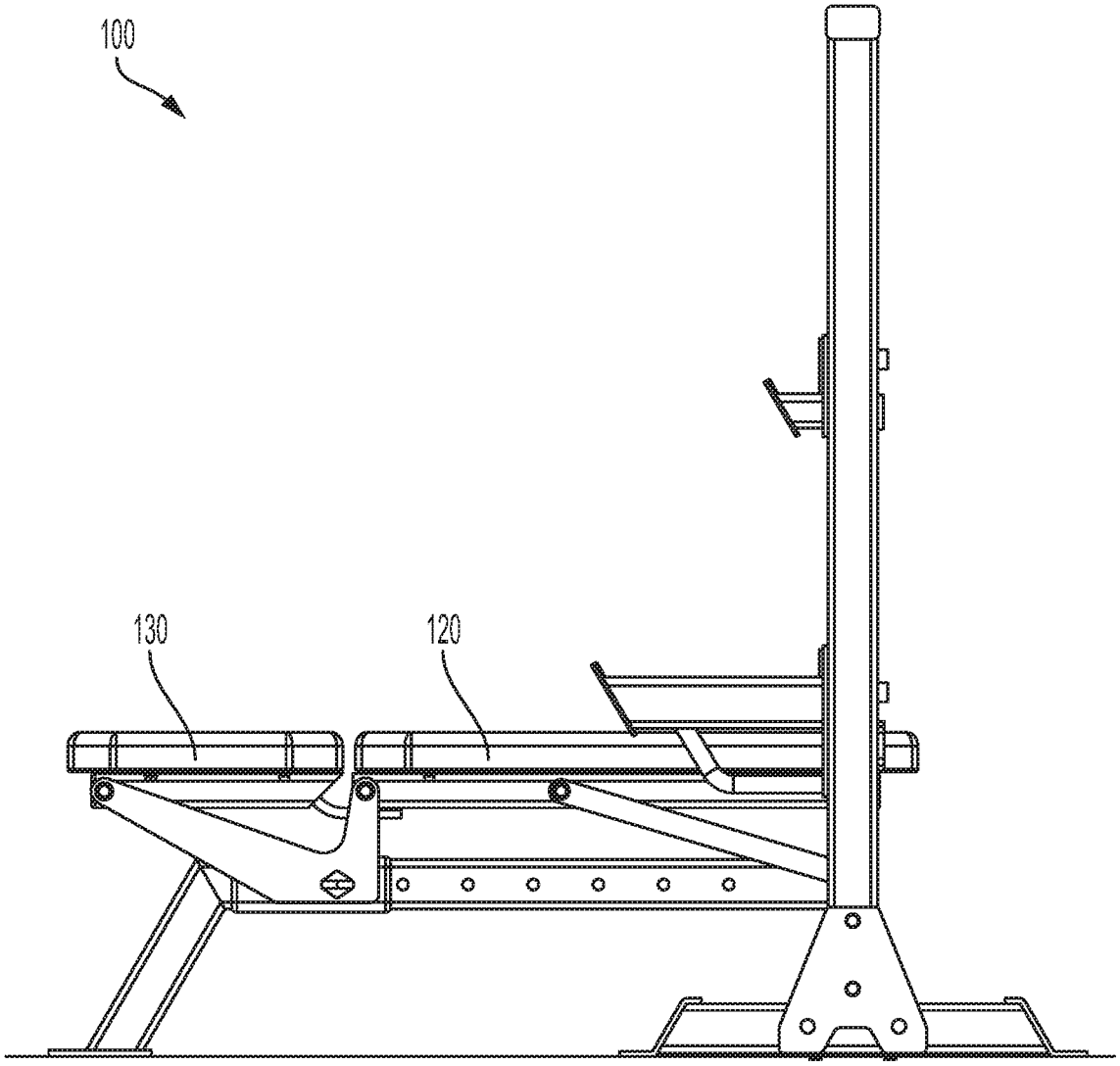
FIGS. 2A-2D illustrate side elevational views of an example adjustable fitness bench.
Figure 2B:
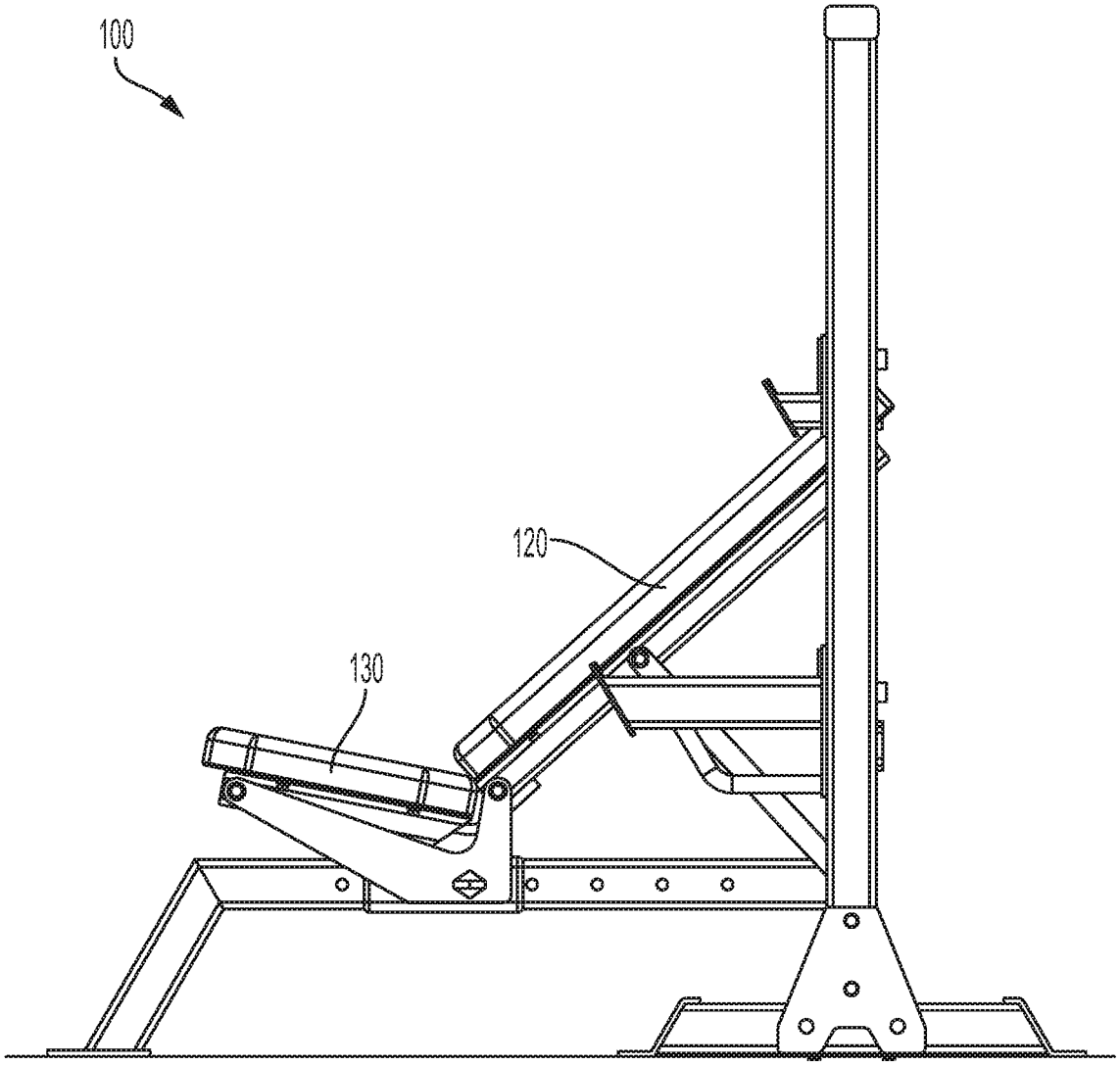
Figure 2C:
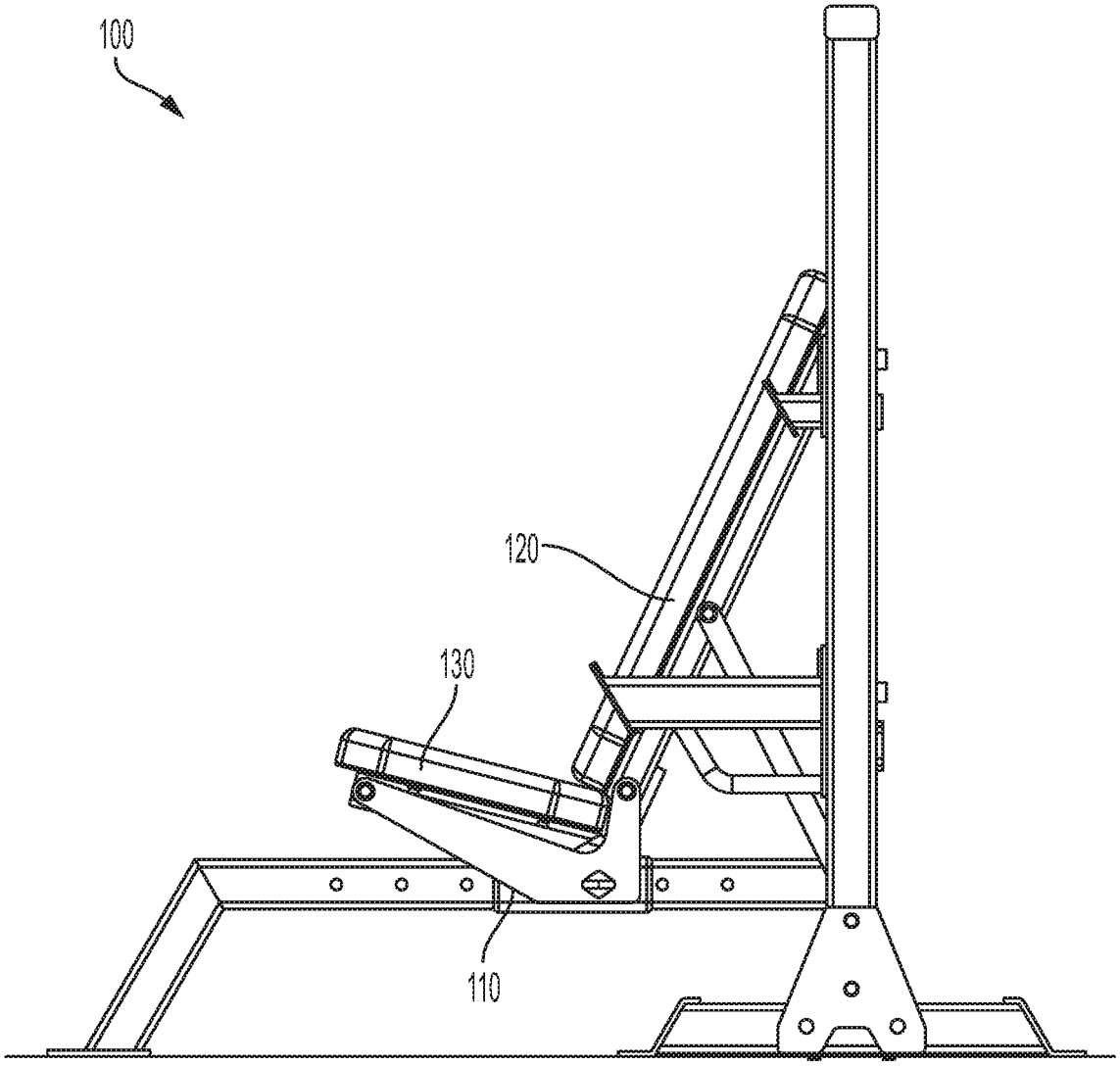
Figure 2D:
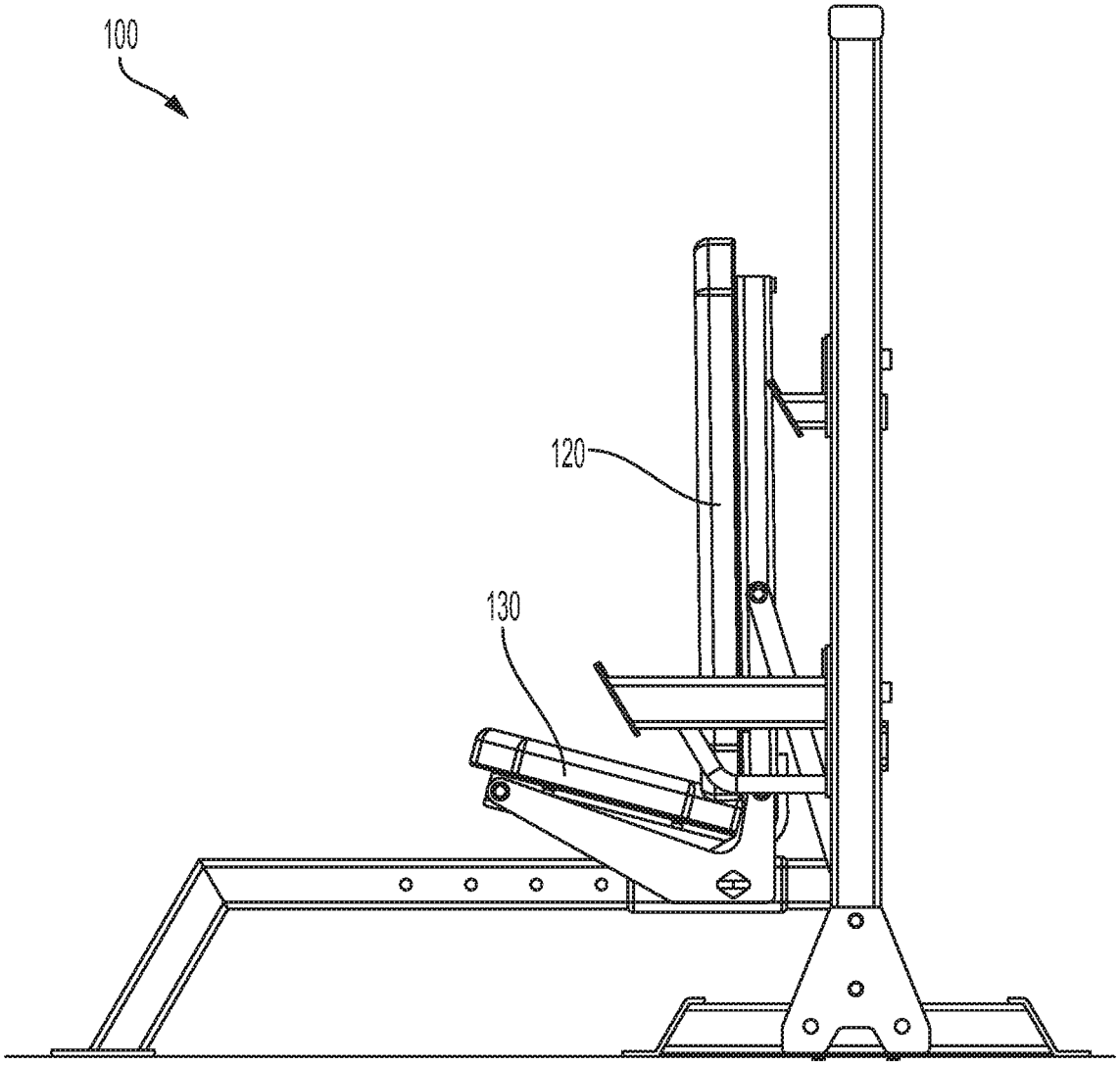

FIGS. 2A-2D illustrate side elevational views of an example adjustable fitness bench 100 with the seat back 120 and seat bottom 130 in various positions. FIG. 2A illustrates an example adjustable fitness bench 100 in a flat position such that the seat back 120 and seat bottom 130 are substantially level. FIG. 2B illustrates an example adjustable fitness bench 100 in a first incline position such that the seat back 120 is raised above and slightly forward over the seat bottom 130. FIG. 2C illustrates an example adjustable fitness bench 100 in a second incline position such that the seat bottom 130 is lowered to a resting position against the shuttle 110, as will be described in more detail below, and the seat back 120 is positioned completely over the seat bottom 130 so that the seat back 120 and seat bottom 130 are substantially perpendicular to one another. FIG. 2D illustrates an example adjustable fitness bench 100 in a third incline position such that the seat back 120 is substantially vertical.

Figure 3:
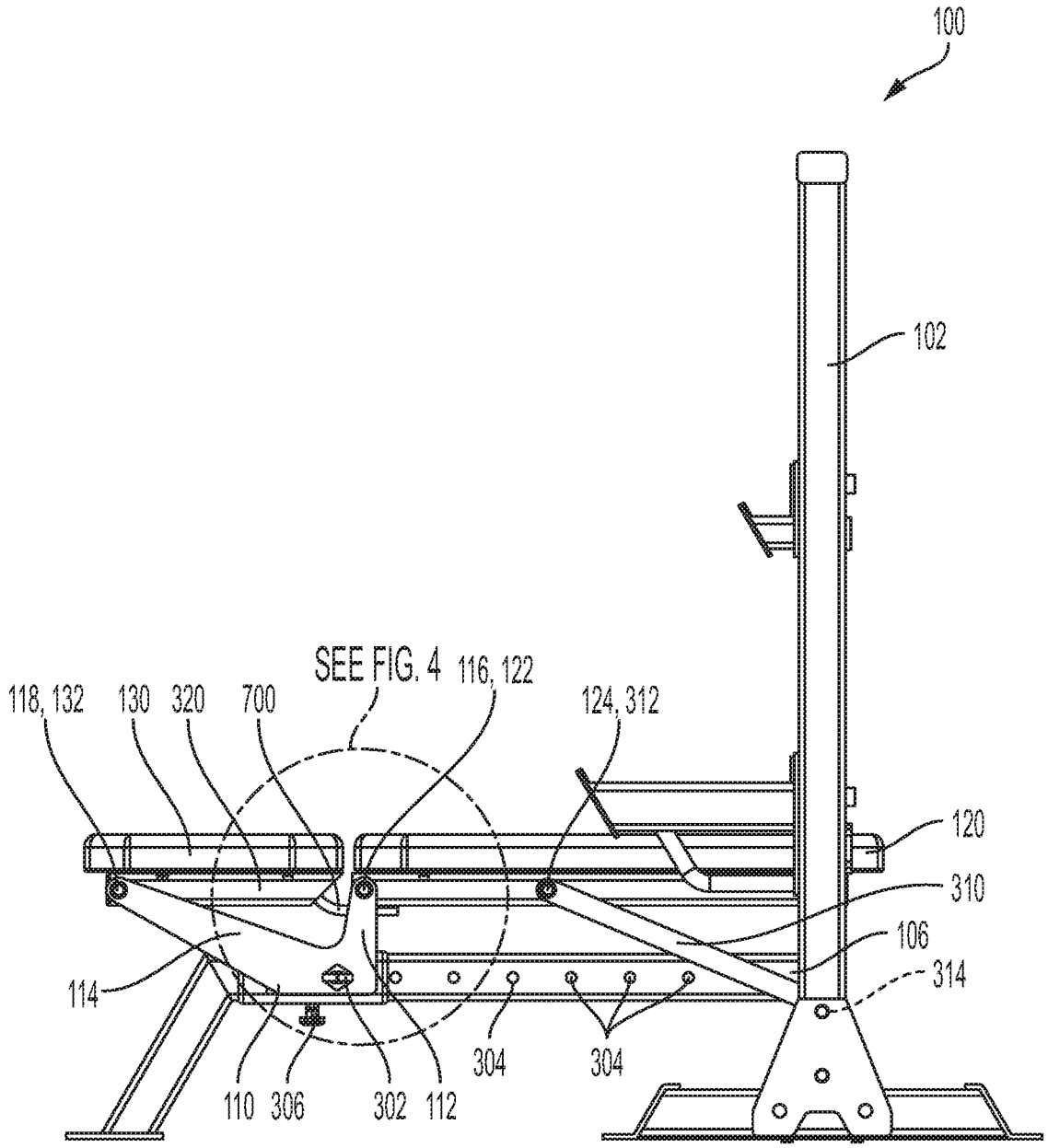
FIG. 3 illustrates a side elevational view of an example adjustable fitness bench.
Figure 4:
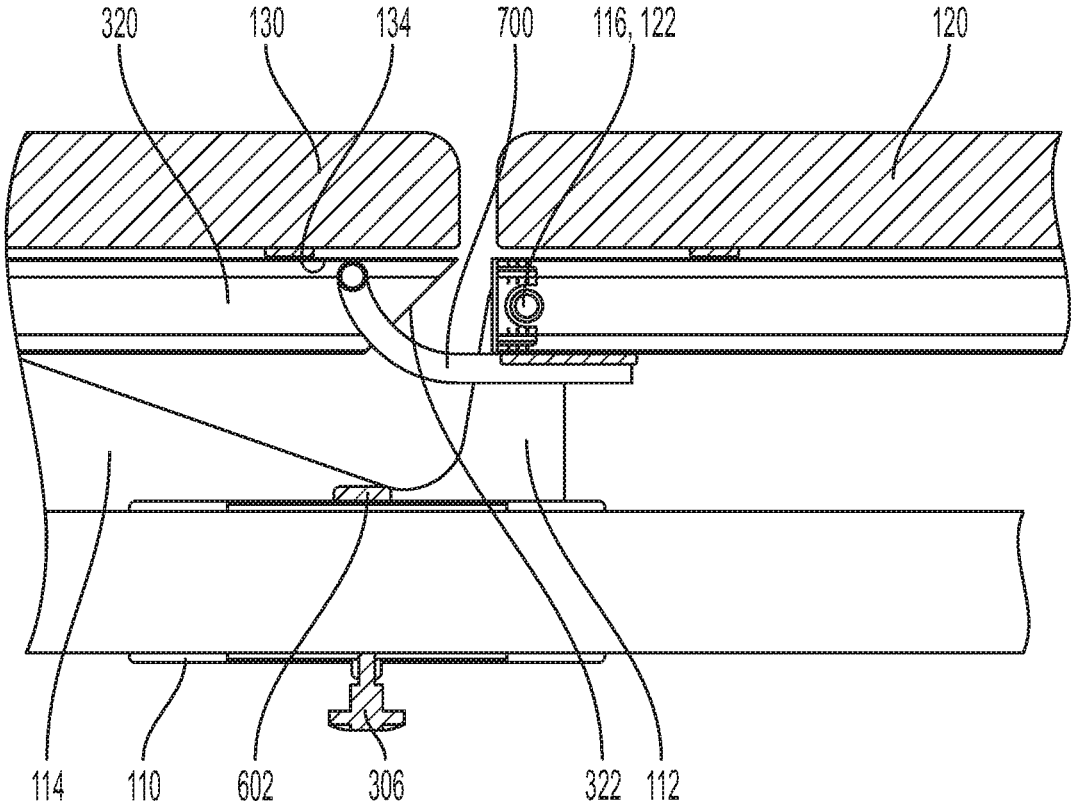
FIG. 4 illustrates a detailed view of a portion of an example adjustable fitness bench in a flat position.
Figure 5:
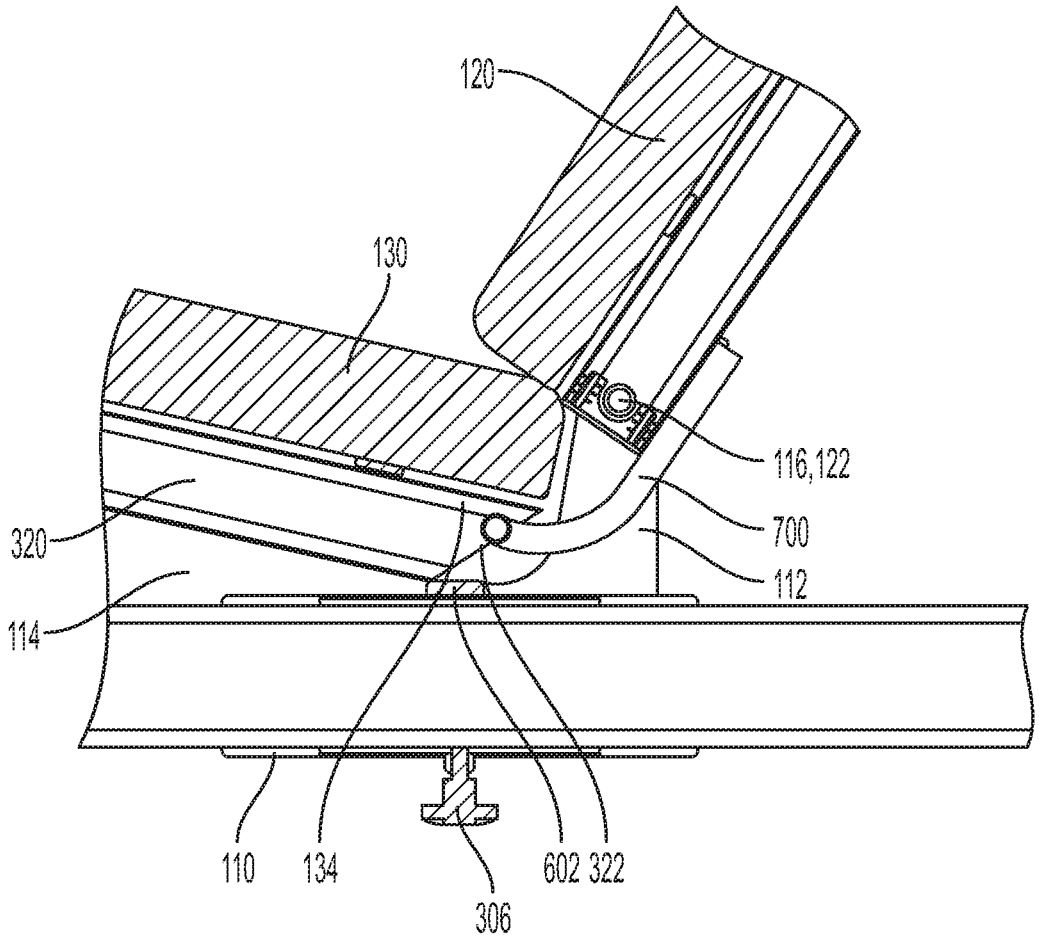
FIG. 5 illustrates a detailed view of a portion of an example adjustable fitness bench in an incline position.

FIG. 3 illustrates a side elevational view of an example adjustable fitness bench 100 according to an embodiment. FIG. 4 illustrates a detailed view of a portion (detail circle 4) of the adjustable fitness bench 100 of FIG. 3 in a flat position. FIG. 5 illustrates a detailed view similar to FIG. 4 with the adjustable fitness bench 100 in an incline position. FIG. 6 illustrates a sectional view of a portion of the adjustable fitness bench 100 along cutline 6-6 of FIG. 1.

Referring to FIG. 3, a position of the seat back 120 and seat bottom 130 may be adjusted by disengaging a connector 302 on the shuttle 110 from an opening 304 on the side of the base frame 106. The connector 302 may be configured to restrict movement of the shuttle 110 along the base frame 106 when in an engaged position. The connector 302 may be, for example, a spring pin, push clip, bolt, sliding pin, threaded pin, and/or the like. The shuttle 110 is then free to transition along the base frame 106 in a sliding motion. The shuttle 110 may also include a securing member 306 for securing a connection of the shuttle 110 to the base frame 106. The securing member 306 may be, for example, a threaded clamp, rotatable camming surface, push wedge, and/or the like. The securing member 306 may reduce unwanted movement, for example wobble, in the connection of the shuttle 110 and the base frame 106 by securing the shuttle 110 to the base frame 106. To move the shuttle 110 along the base frame 106, for example, a user may loosen the securing member 306, pull a portion of the connector 302 outward from an opening 304 on the base frame 106, slide the shuttle 110 along the base frame 106 until the connector 302 aligns with a desired opening 304, insert a portion of the connector 302 into the new placement opening 304, and retighten the securing member 306 to the surface of the base frame 106. The shuttle 110 may include more than one securing member 306 positioned against one or more surfaces of the base frame 106, according to an embodiment.

The shuttle 110 may include a first extension 112 and a second extension 114, each extending away from the shuttle 110. The first extension 112 may include a seat back pivot 116 at a distal end of the first extension 112. The seat back pivot 116 may allow for pivotal connection of the first extension 112 to the seat back 120. Likewise, the second extension 114 may include a seat bottom pivot 118 at a distal end of the second extension 114. The seat bottom pivot 118 may allow for pivotal connection of the second extension 114 to the seat bottom 130. In various embodiments, the first extension 112 and/or the second extension 114 may extend from one side of the shuttle 110. Alternatively, the shuttle 110 may have a pair of extensions 112, 114 on both sides of the shuttle 110 forming two seat back pivots 116, and two seat bottom pivots 118.

A support bar 310 may extend between the support post 108 of the base frame 106 and the seat back 120. The support bar 310 may include a first pivot connection 312 near one end of the support bar 310 which may allow for pivotal connection to the seat back 120. The support bar 310 may include a second pivot connection 314 near the other end of the support bar 310 which may allow for pivotal connection to the base frame 106.

The seat back 120 may include a shuttle pivot 122 allowing for pivotal connection to the seat back pivot 116 of the first extension 112 of the shuttle 110. The seat bottom 130 may include a support bar pivot 124 allowing for pivotal connection to the first pivot connection 312 of the support bar 310.

A link 700 may be positioned between the seat back 120 and the seat bottom 130, as will be described in more detail below. While the shuttle 110 slides along the base frame 106, the link 700 may assist adjusting the angle of the seat back 120 and the seat bottom 130. This adjustment may allow the gap between the seat back 120 and seat bottom 130 to be reduced in one or more incline positions.

The seat bottom 130 may include a shuttle pivot 132 allowing for pivotal connection to the seat bottom pivot 118 of the second extension 114 of the shuttle 110. The seat bottom 130 may include an undersurface 134 (see FIG. 4). At least a portion of the link 700 may contact at least a portion of the undersurface 134 during adjustment of the seat back 120 and/or the seat bottom 130.

According to an embodiment, the undersurface 134 of the seat bottom 130 may include a channel. The channel may be formed by an angular cut end 322 of a rectangular hollow bar 320 as shown in FIG. 4. Additional and/or alternate configurations of the channel may be used within the scope of this disclosure. The undersurface 134 of the seat bottom may provide a surface upon which at least a portion of the link 700 may support the seat bottom 130 from underneath and may slide against to allow for sliding contact between the seat back 120 and seat bottom 130, as will be described in more detail below.

The seat back 120 and seat bottom 130, as shown in FIG. 4, may be fabricated from compressible resilient material for the comfort of the user while lying on the adjustable fitness bench 100 and lifting weights. Such materials may include, for example, soft goods, foam, wood, gel, metal, plastic, padding or the like.

Figure 6A:
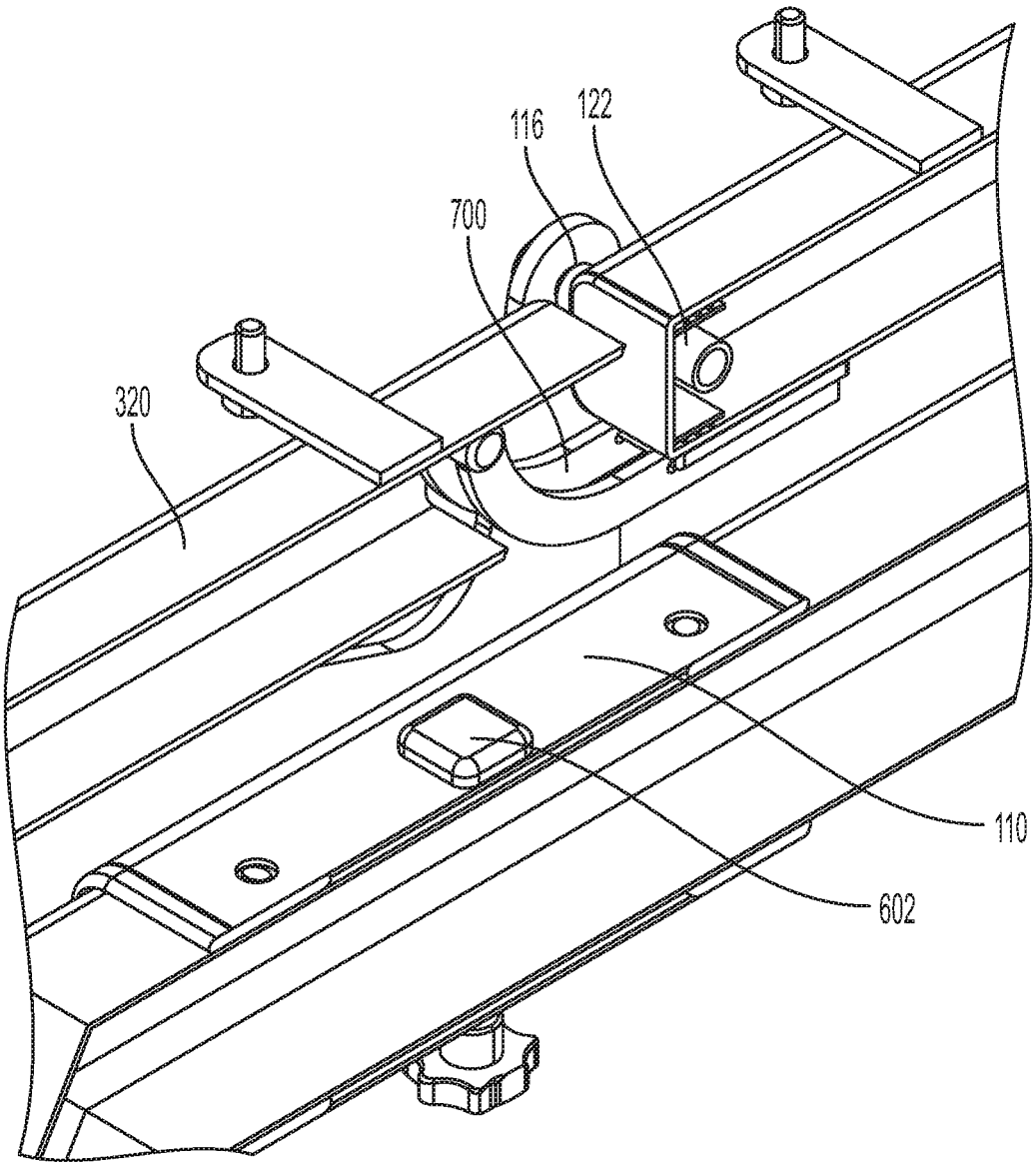
FIGS. 6A and 6B each illustrate a sectional view of a portion of an example adjustable fitness bench.

The shuttle 110, as shown in FIG. 6A, may include one or more bumpers 602 upon which a portion of the bar 320 may rest when the bench is placed in an incline position, such as, for example, that shown in FIGS. 2C and 5. The bumper 602 may be fabricated from natural rubber, Silicone rubber, Neoprene rubber, Butyl rubber, Ethylene Propylene Diene Monomer (EPDM) rubber, Nitrile butadiene rubber (NBR), foam, cork and/or the like.

Figure 6B:
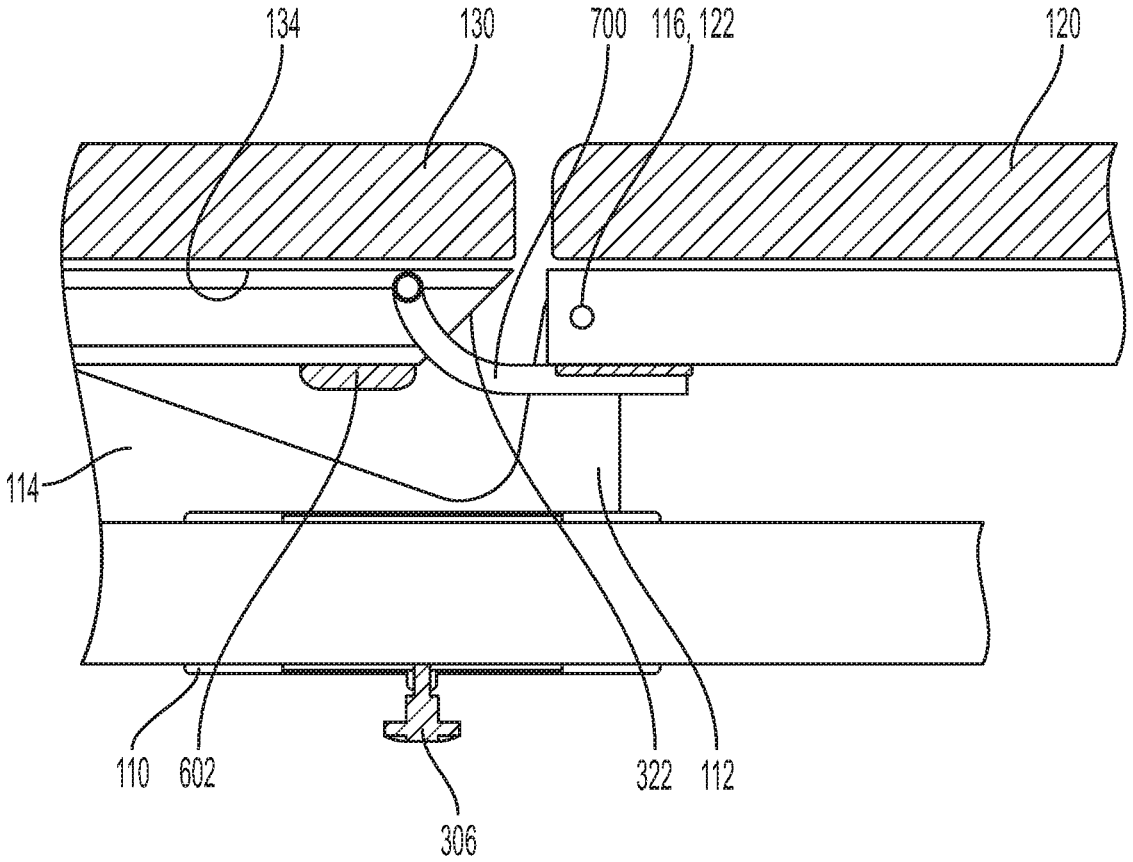

In various embodiments, one or more bumpers may be positioned on a portion of the bar 320 as illustrated in FIG. 6B. When the bench is placed in an incline position, such as, for example, that shown in FIGS. 2C and 5, the bumper of the bar 320 may contact at least a portion of the shuttle 110.

Figure 7A:
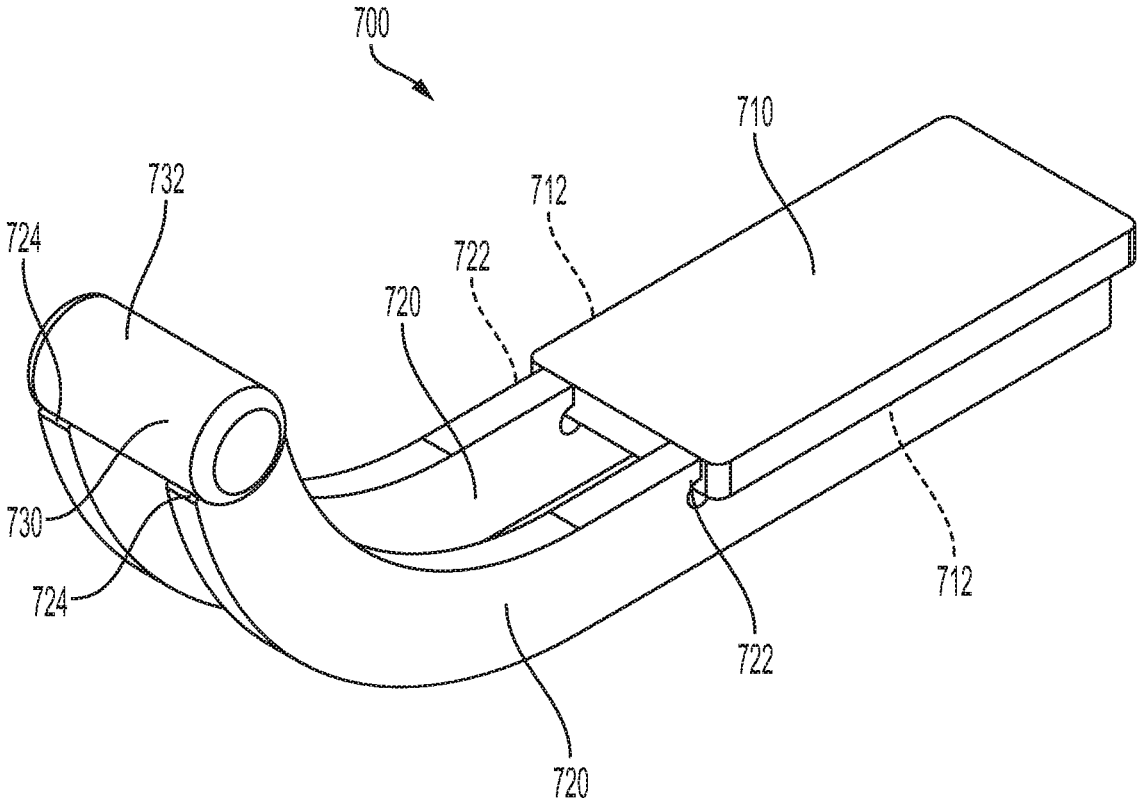
FIGS. 7A-7C illustrate examples of links of an adjustable fitness bench according to various embodiments.

FIG. 7A illustrates an isometric view of the link 700. The link 700 may extend from a portion of the seat back 120 and provide a sliding surface against which the undersurface 134 of the seat bottom 130 may rest. In an embodiment, the link 700 may include two parallel link hooks 720. Each of the link hooks 720 may extend away from and upward from a first end of the link towards a second end of the link. In various embodiments, a link may include a single link hook 720 or more than two link hooks.

In various embodiments, a link may include a link plate 710. A link plate may be a substantially flat surface that covers at least a portion of one or more of the link hook(s) 720. A link 700 may be connected to a seat back 120 via the link plate 710. A groove 722 along a first edge of each link hook 720 may provide a receptacle for the edge 712 of the link plate 710.

Figure 7B:
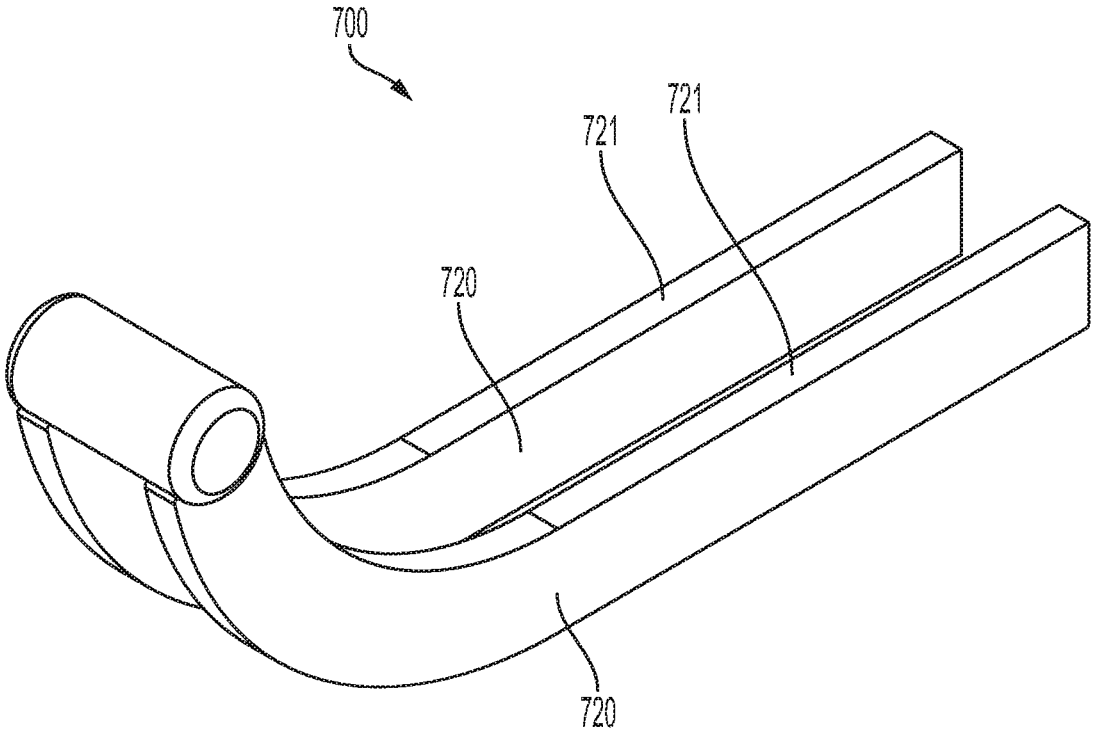

In an alternate embodiment, a link may not include a link plate as illustrated by FIG. 7B. In this embodiment, a link 700 may be connected to a seat back 120 via a surface 721 of one or more of the link hooks 720.

In various embodiments, a link 700 may include a link end 730. One of these embodiments is illustrated in FIG. 7A, which shows the link end 730 as a cylindrical bar fixed to an end of the link hooks 720. The link end 730 may include a solid core or it may be hollow. A curved groove 724 along a second edge of each link hook 720 may provide a receptacle for the link end 730. The curved surface 732 of the link end 730 may provide a sufficient sliding contact surface to support the undersurface 134 of the seat bottom 130. The curved surface 732 of the link end 730 may also have a low coefficient of friction to allow to provide a smooth surface for sliding contact.

Figure 7C:
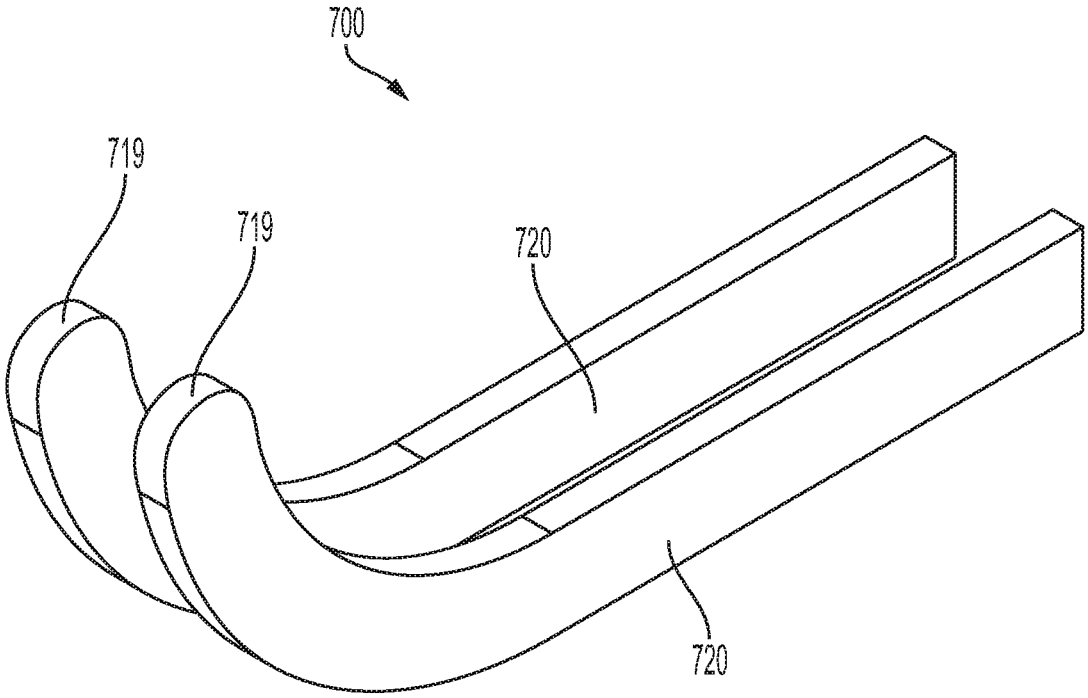

In other embodiments, a link 700 may not include a link end. Rather, an end portion of one or more link hooks 720 may have a finished end portion 719 that may be configured to rest against and/or underneath a seat bottom 130, depending on the configuration of the bench, as illustrated by FIG. 7C. A link plate 710 may or may not be used with a link of this configuration. Although FIG. 7C illustrates a link 700 having a finished end portion 719 that is generally rounded, it is understood that different designs or configurations, such as for example, squared off, may be used within the scope of this disclosure.

In operation, the link 700 may allow the seat back 120 and seat bottom 130 to be connected with a sliding contact. This sliding contact allows the seat back 120 to rotate up and forward over the back edge of the seat bottom 130 when transitioning from the flat position to the incline position as shown in FIGS. 2B-2D and may reduce the size of the gap between the seat back 120 and the seat bottom 130 in the incline position.

Figure 8A:
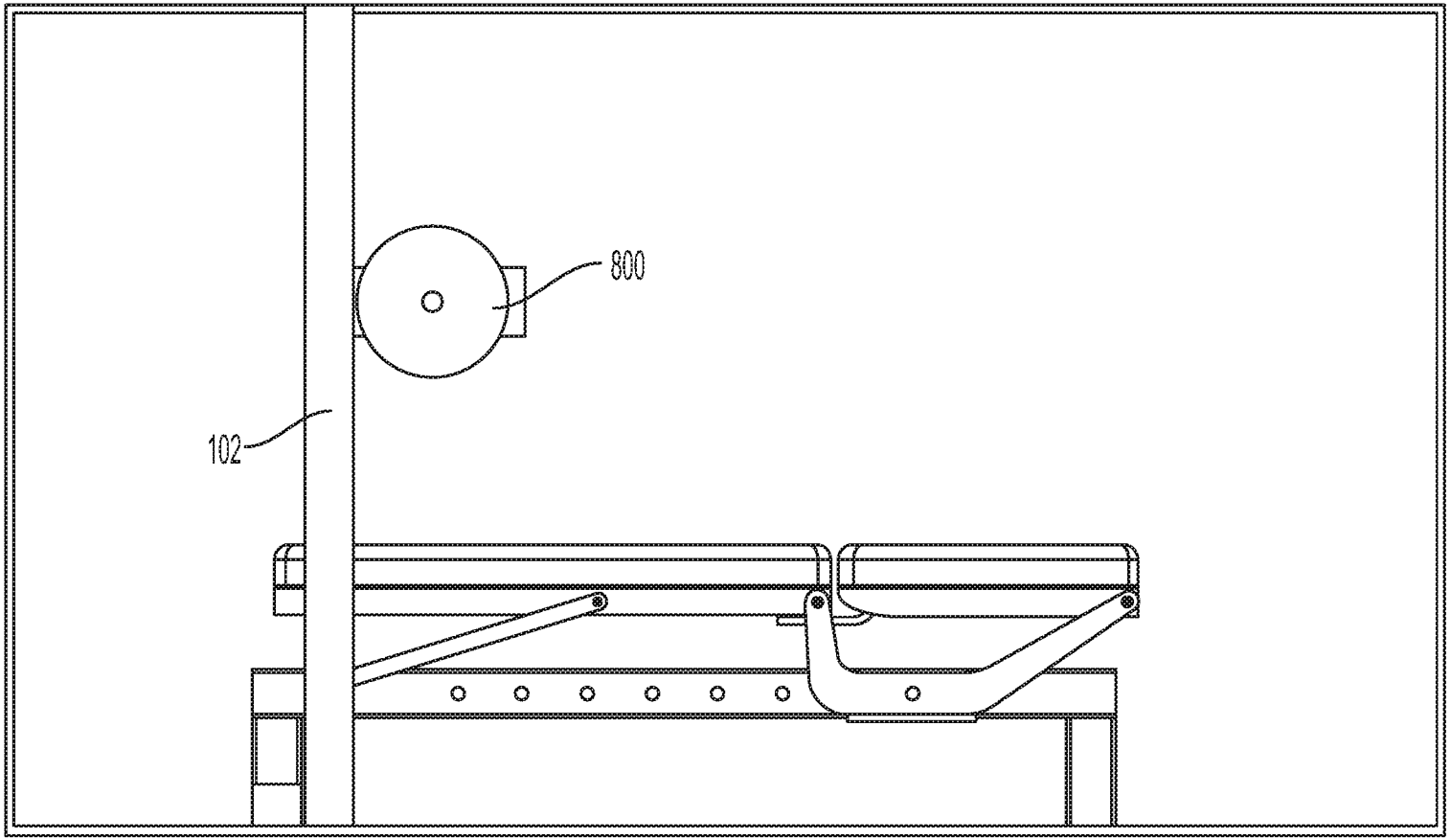
FIGS. 8A and 8B illustrates an example adjustable fitness bench and weight rack according to various embodiments.
Figure 8B:
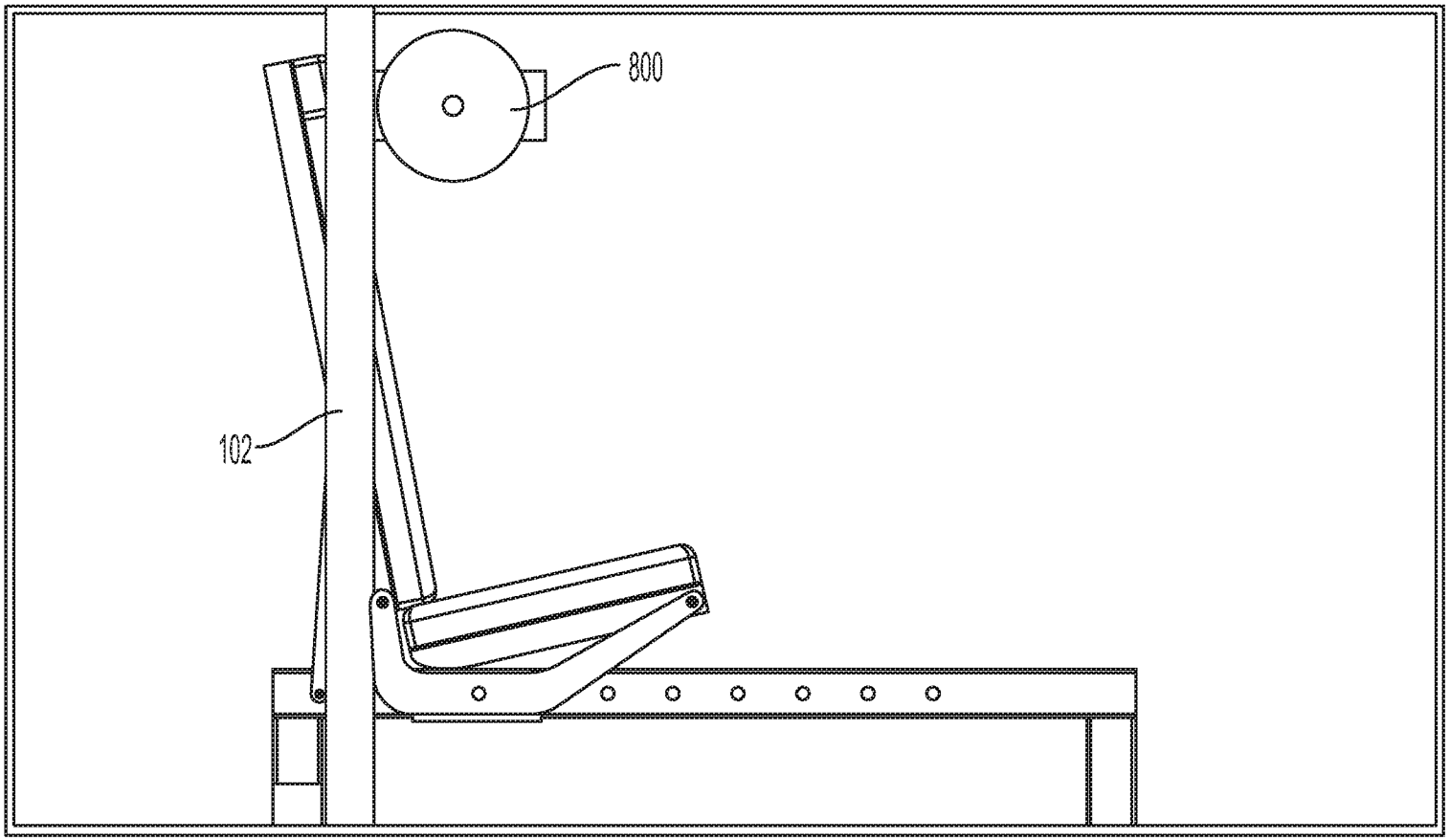

In various embodiments, when the adjustable fitness bench 100 is used with a weight rack (such as, for example, the upright posts 102, the weight 800 on the rack may be positioned vertical of the head of the user in the bench's horizontal positon, as illustrated in FIG. 8A. This position may be maintained in the same general plane when the adjustable fitness bench is transitioned to a seated position, as illustrated in FIG. 8B.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

In this document, when terms such "first" and "second" are used to modify a noun, such use is simply intended to distinguish one item from another, and is not intended to require a sequential order unless specifically stated. The terms "approximately" and "about" when used in connection with a numeric value, is intended to include values that are close to, but not exactly, the number. For example, in some embodiments, the term "approximately" may include values that are within +/−10 percent of the value.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An adjustable fitness bench comprising:
a base frame;
a shuttle slidable along at least a portion of the base frame;
a support bar pivotally connected to the base frame;
a seat back pivotally connected to the shuttle and the support bar;
a seat bottom pivotally connected to the shuttle; and
a link comprising:
a first end connected to the seat back, and
a second end configured to rest against an undersurface of the seat bottom when the adjustable fitness bench is in a horizontal position.

2. The adjustable fitness bench of claim 1, wherein a portion of the link is configured to slide along at least a portion of the undersurface.

3. The adjustable fitness bench of claim 1, wherein the link further comprises a plurality of
link hook portions that each extend away from a first end of the link and upward toward a second end of the link.

4. The adjustable fitness bench of claim 3, wherein the link further comprises a link end located at the second end of the link, wherein the link end is configured to:
attach to a portion of each of the link hook portions, and
slide along at least a portion of the undersurface.

5. The adjustable fitness bench of claim 3, wherein the link further comprises a link plate positioned such that it covers at least a portion of each of the link hook portions, wherein the link plate is configured to attach to the seat back.

6. The adjustable fitness bench of claim 1, wherein the shuttle comprises:
a first extension having a first pivot connection; and
a second extension having a second pivot connection.

7. The adjustable fitness bench of claim 6, wherein:
the seat back is pivotally connected to the first extension; and
the seat bottom is pivotally connected to the second extension.

8. The adjustable fitness bench of claim 1, wherein one or more of the seat back or the seat bottom is configured to transition between the horizontal position and at least one incline position when the shuttle is moved along the base frame.

9. The adjustable fitness bench of claim 8, wherein:
the shuttle includes a bumper along an upper surface; and
the seat bottom is configured to rest against at least a portion of the bumper in the at least one incline position.

10. The adjustable fitness bench of claim 8, wherein the seat bottom includes a bumper on the undersurface, wherein the bumper is configured to contact the shuttle in the at least one incline position.

11. The adjustable fitness bench of claim 8, wherein the shuttle includes a connector that is configured to restrict movement of the shuttle along the base frame when in an engaged position.

12. The adjustable fitness bench of claim 11, wherein the connector comprises one or more of the following:
a spring pin;
a push clip;
a bolt;
a sliding pin; or
a threaded pin.

13. The adjustable fitness bench of claim 8, wherein the shuttle includes a securing member configured to secure the shuttle to the base frame.

14. The adjustable fitness bench of claim 1, wherein:
the base frame includes a post; and
the seat back is configured to rest against a top surface of the post in the horizontal position.

15. The adjustable fitness bench of claim 14, wherein the post includes a bumper along the top surface upon which the seat back is configured to rest.

16. An adjustable fitness bench comprising:
a base frame;
a shuttle slidable along at least a portion of the base frame;
a support bar pivotally connected to the base frame;
a seat back pivotally connected to the shuttle and the support bar;
a seat bottom pivotally connected to the shuttle; and
a link comprising:
a first end connected to the seat back, and
a second end configured to not contact the seat bottom when the adjustable fitness bench is in a vertical position.

17. The adjustable fitness bench of claim 16, wherein the link further comprises a plurality of link hook portions that each extend away from a first end of the link and upward toward a second end of the link, wherein at least a portion of the second end of the link is configured to slide along at least a portion of an undersurface of the seat bottom when the bench is transitioned between the vertical position and a horizontal position.

18. The adjustable fitness bench of claim 16, wherein the link further comprises a plurality of link hook portions that each extend away from a first end of the link and upward toward a second end of the link, wherein the second end of the link comprises a link end that is configured to slide along at least a portion of an undersurface of the seat bottom when the bench is transitioned between the vertical position and a horizontal position.

19. The adjustable fitness bench of claim 16, wherein the link further comprises a link plate that is configured to attach to the seat back.

20. The adjustable fitness bench of claim 16, wherein the link further comprises a plurality of link hook portions that each extend away from a first end of the link and upward toward a second end of the link, wherein a surface of each of the link hook portions is configured to attach to the seat back.

21. A link for an adjustable fitness bench, the link comprising:
a plurality of link hook portions, wherein each link hook portion extends from a first end of the link upwards toward a second end of the link,
wherein at least a portion of the first end of the link is configured to attach to a seat back of an adjustable fitness bench,
wherein at least a portion of the second end is configured to slide along at least a portion of an undersurface of a seat bottom of the adjustable fitness bench when a position of the seat back or seat bottom is adjusted.

* * * * *